US006771171B2

(12) United States Patent
Light et al.

(10) Patent No.: US 6,771,171 B2
(45) Date of Patent: Aug. 3, 2004

(54) ATOMIC VIRTUAL DOCUMENT GENERATION AND TAGGING

(75) Inventors: John Light, Beaverton, OR (US); Dhananjay Keskar, Beaverton, OR (US); Alan McConkie, Gaston, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/933,612

(22) Filed: Aug. 20, 2001

(65) Prior Publication Data

US 2003/0034892 A1 Feb. 20, 2003

(51) Int. Cl.[7] ..... G08B 13/14

(52) U.S. Cl. ..... 340/572.1; 340/586.1; 340/576; 235/375; 235/380; 235/385; 235/468; 358/468

(58) Field of Search ..... 340/572.1, 586.1, 340/576, 425; 235/375, 380, 385, 468; 358/468

(56) References Cited

U.S. PATENT DOCUMENTS

| | | | | | |
|---|---|---|---|---|---|
| 4,918,540 | A | * | 4/1990 | Ohtani | 382/239 |
| 5,514,860 | A | * | 5/1996 | Berson | 235/468 |
| 5,594,838 | A | * | 1/1997 | Christopher et al. | 358/1.18 |
| 5,754,308 | A | * | 5/1998 | Lopresti et al. | 358/403 |
| 5,841,116 | A | * | 11/1998 | Lewis | 235/375 |
| 6,056,195 | A | * | 5/2000 | Spain | 235/432 |
| 6,435,410 | B2 | * | 8/2002 | Edens et al. | 235/454 |
| 6,608,551 | B1 | * | 8/2003 | Anderson et al. | 340/10.51 |

* cited by examiner

*Primary Examiner*—Daniel J. Wu
*Assistant Examiner*—Tai T. Nguyen
(74) *Attorney, Agent, or Firm*—Blakely, Sokoloff, Taylor & Zafman LLP

(57) ABSTRACT

Atomic virtual document generation and tagging is described. A virtual article that is intelligible to a digital processing system is generated from a physical materiality. The physical materiality is marked with an identifier. The virtual article is tagged with a tag that corresponds to the identifier. The generating of the virtual article, the marking of the physical materiality, and the tagging of the virtual article occur at substantially the same time.

28 Claims, 8 Drawing Sheets

ATOMIC VIRTUAL DOCUMENT GENERATION AND TAGGING

FIELD OF THE INVENTION

The field of the invention relates to virtual document generation in general and to tagging a virtual document in particular.

BACKGROUND

Currently, when a physical document interfaces with a computer environment, two types of actions may be performed. One operation is the "scanning" of the document into the computer. Scanning may involve either storing an image of the document or conversion of the physical document into computer text using optical character recognition (OCR), or both. Optical character recognition is the machine recognition of printed characters. OCR systems can recognize many different OCR fonts, as well as typewritten or computer-printed characters. Advanced OCR systems can recognize hand printing.

After a document is scanned/converted into a computer format (a "virtual" document), a further step, known as "tagging", may take place. Tagging entails placing an identification on the document so that it can be referred to and accessed later. The tag may be placed on the physical and/or virtual document. This tagging step in some cases is omitted, making it more difficult to later recognize the document.

The two steps of scanning and tagging a document have, in prior art, been considered related but unconnected events, taking place at separate times and/or using separate instruments. To illustrate, in a hospital environment, patient records are kept in a variety of physical and virtual forms. These two formats need to be rationalized. Currently, the process of converting paper records into computer records is somewhat ad hoc, usually occurring either at the end of the day or at the end of care. Additionally, the conversion process typically takes place in an inconvenient location and the process may or may not involve tagging of the documents. If tagging is involved, it requires a separate device. The risk of error and omission of records is increased as a result of these factors. Many paper records will therefore not become available on-line and computer systems are kept from being fully utilized.

DETAILED DESCRIPTION

Atomic virtual document generation and tagging is described. In the following description, for purposes of explanation, numerous specific details are set forth in order to provide a thorough understanding of the invention. However, it will be apparent to one with ordinary skill in the art that these specific details need not be used to practice the present invention. In other instances, well-known structures and devices are shown in block diagram form in order to avoid unnecessarily obscuring the present invention.

A virtual article that is intelligible to a digital processing system is generated from a physical materiality. The physical materiality is marked with an identifier. The virtual article is tagged with a tag that corresponds to the identifier. The generating of the virtual article, the marking of the physical materiality, and the tagging of the virtual article occur at substantially the same time. Generating and tagging virtual documents atomically encourages the timely addition of paper records to the virtual record. The effectiveness of computer systems may thus be increased and the reliance upon paper records reduced. Current business artifacts (mostly paper) can thereby be linked to ubiquitous virtual records.

Figure 1:
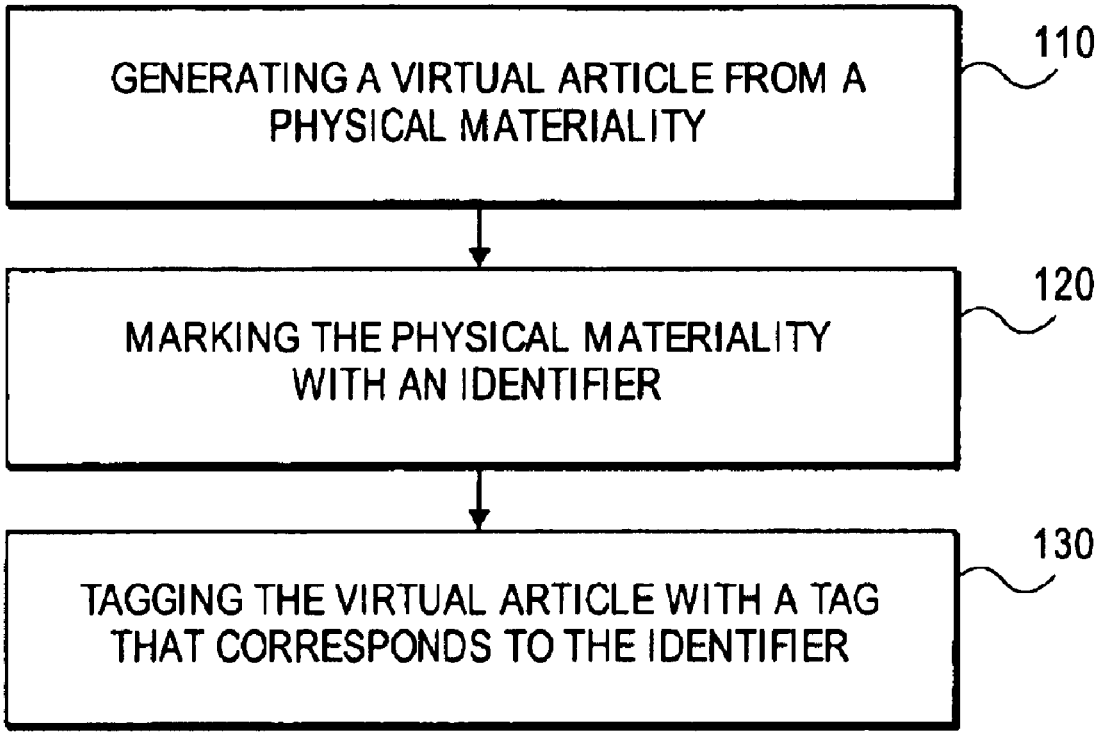
FIG. 1 is a flow diagram of one embodiment of a virtual document generation/tagging process.
Figure 6:
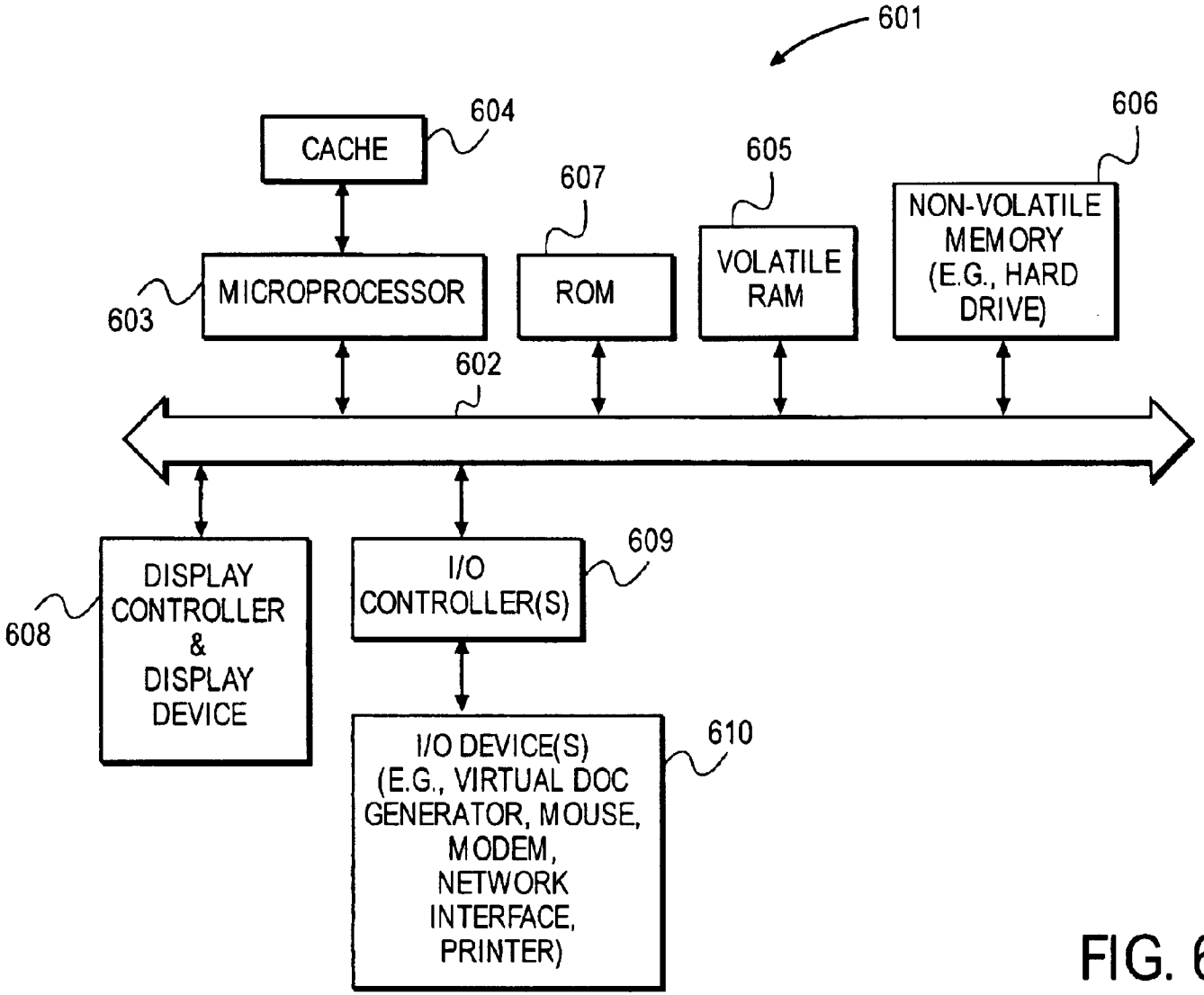
FIG. 6 is a diagram of an operating environment suitable for practicing the present invention.

FIG. 1 is a flow diagram of one embodiment of the virtual document generation/tagging process, which may be executed in an environment such as the environment of FIG. 6. At block 110, a virtual article is generated from a physical materiality. In one embodiment, the generating of a virtual article may be by any state of the art document conversion technology, such as optical character recognition (OCR). At block 120, the physical materiality is marked with an identifier. At block 130, the virtual article is tagged with a tag that corresponds to the identifier. The term "virtual" refers to a feature or state that is simulated in some fashion, i.e. digitally. The term "physical" means existing as or connected with things that can be seen or touched. The term "article" means a particular thing or item. The term "materiality" means the quality or state of consisting of matter. The term "materiality" is used interchangeably with the term "document". The term "tag" means an element attached to an item and containing information about it. The term "identifier" means an element that identifies an object.

In one embodiment, the generating, marking and tagging occur at substantially the same time. In another embodiment, the marking may be omitted, i.e a virtual article that is intelligible to a digital processing system may be generated from a physical materiality and the virtual article may be tagged with an identifying tag. In such case, the generating and the tagging may be performed at substantially the same time. Similar functions, though not all of the same functions, may be performed where the marking is omitted as where the marking is included. For example, in either case, the functionality of recognizing the virtual article by its tag may be present.

The physical materiality may be a document having text, an illustration, a hand written note, a biological sample, or a chemical sample, but the invention is not so limited. The identifier may be a label, a code printed onto the physical materiality, a digital overlay, or a radio frequency identification (RFID) tag, but the invention is not so limited. In one embodiment, the physical materiality has no-precoding of identifying information.

In one embodiment, the generating further comprises performing a physical analysis. The physical may be a spectral analysis, a chromatographic analysis, or a DNA analysis, but the invention is not so limited.

Figure 2:
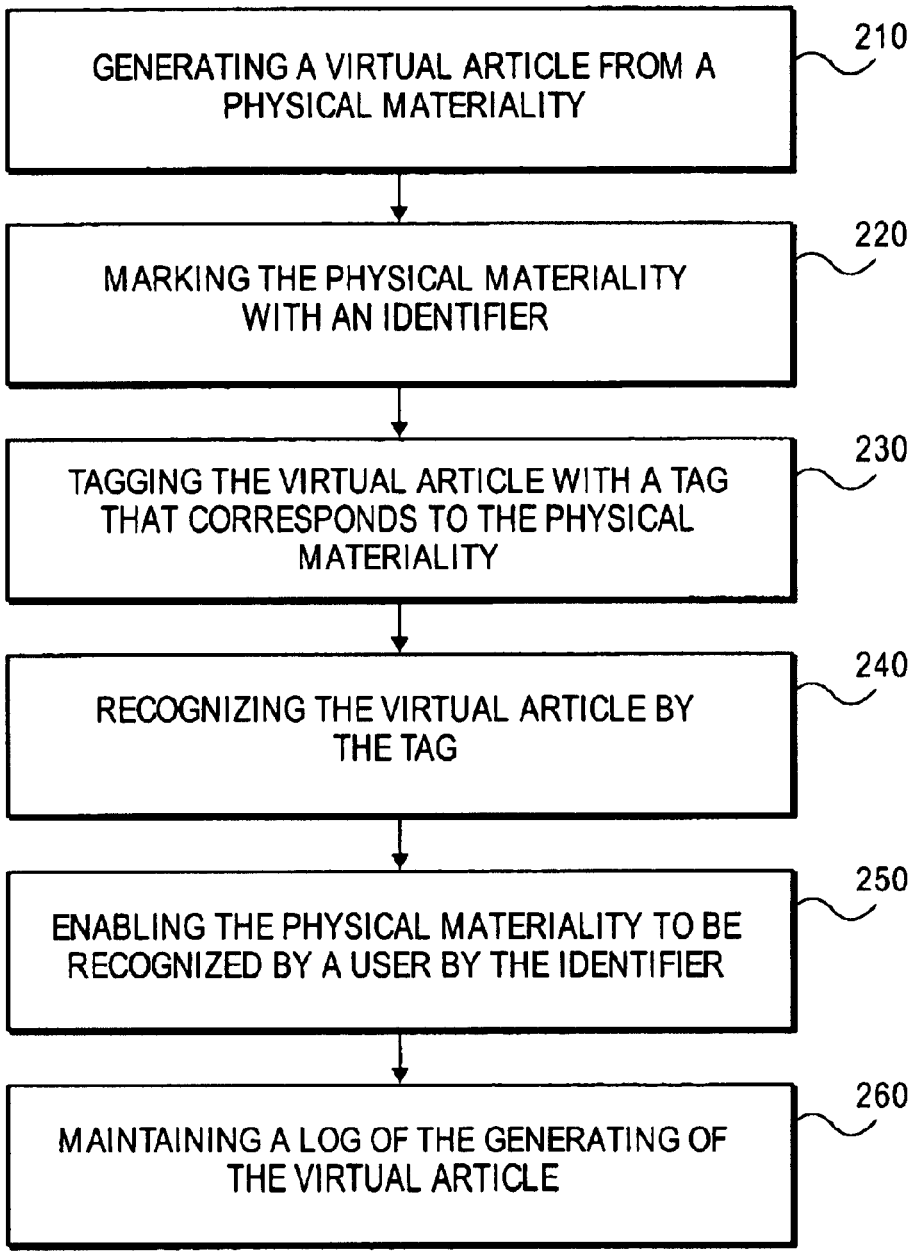
FIG. 2 is a flow diagram of another embodiment of the virtual document generation/tagging process.

FIG. 2 is a flow diagram of another embodiment of the virtual document generating/tagging process. At block 210, the virtual article is generated from a physical materiality. At block 220, the physical materiality is marked with an identifier. At block 230, the virtual article is tagged with a tag that corresponds to the identifier. At block 240, the virtual article is recognized by the tag by a digital processing system for access and retrieval of information. At block 250, the physical materiality is recognized by the identifier by a user for additional use or modifications. At block 260, a log of the generating of the virtual article is maintained. The log may record the number of virtual articles generated as well as an identification for each virtual article generated. In one embodiment, the log may comprise the tag, the virtual article, and/or a copy of the virtual article. The log may be used to track the generation of virtual documents.

Figure 3:
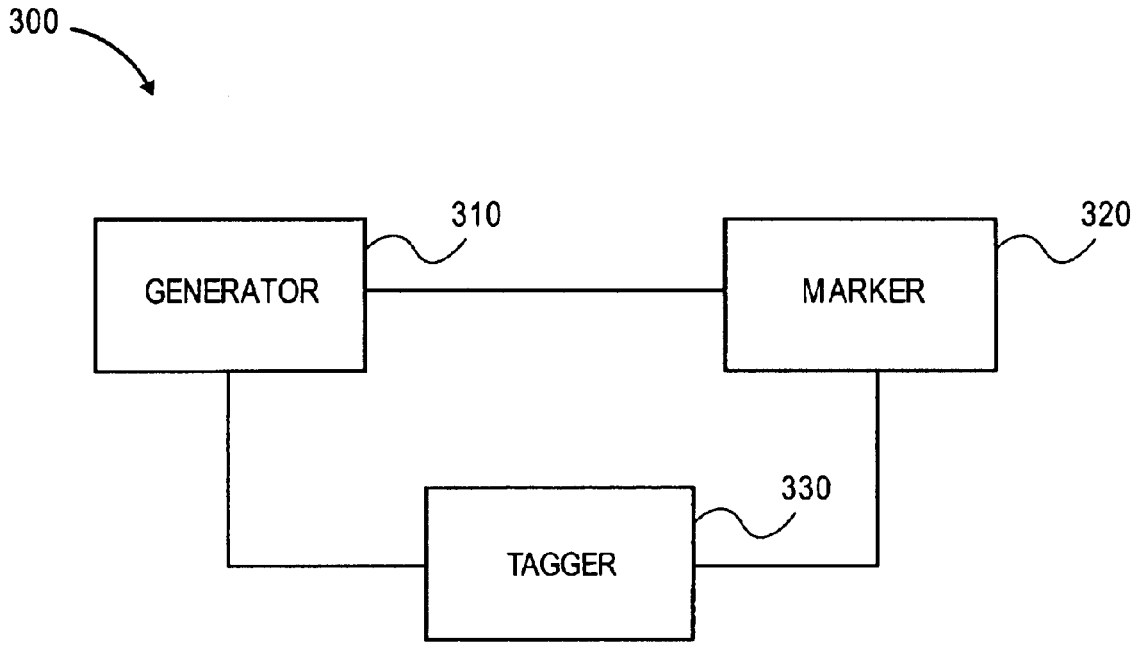
FIG. 3 is a block diagram of one embodiment of a generating/tagging system.
Figure 4:
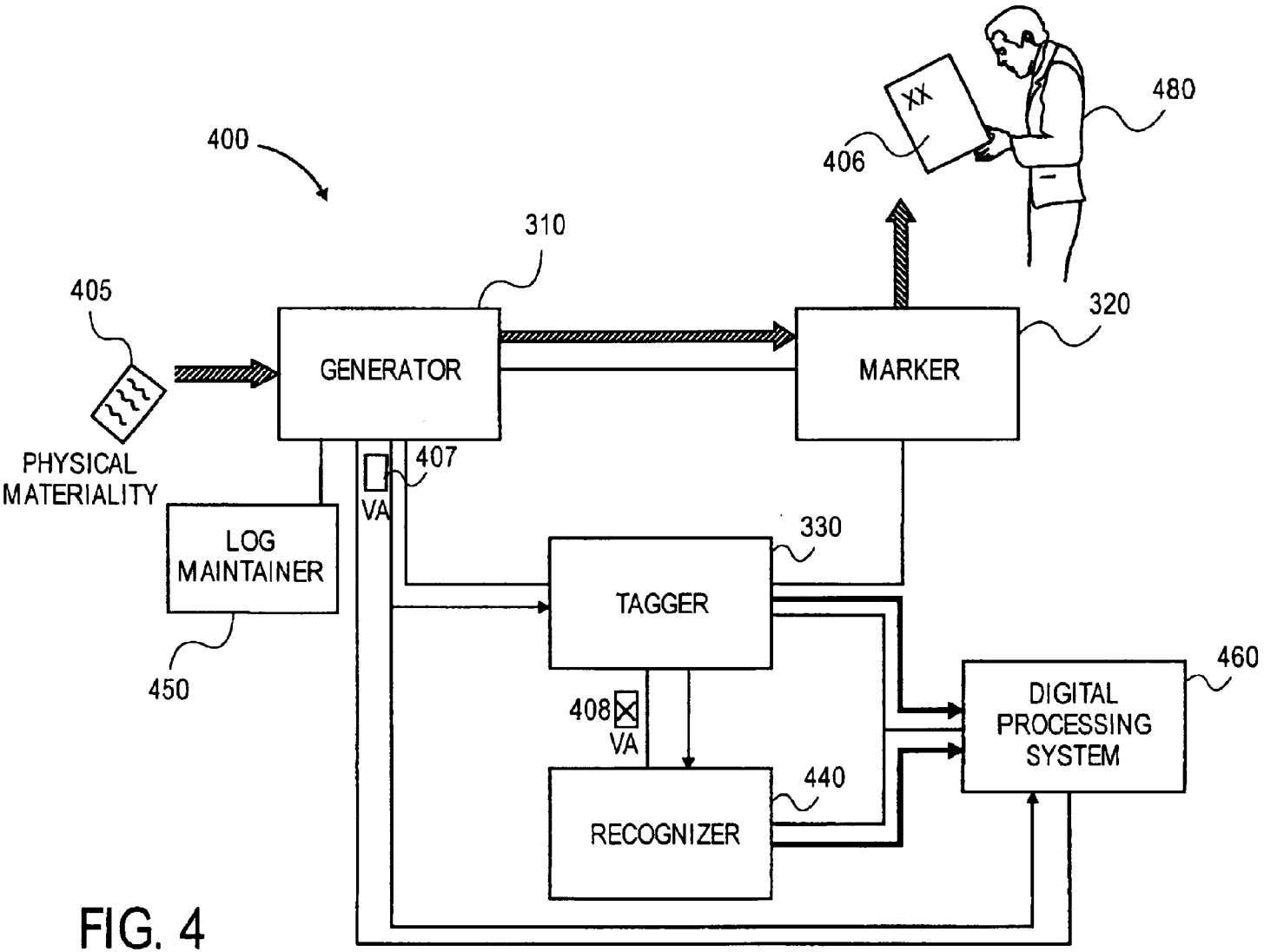
FIG. 4 is a block diagram of another embodiment of the generating/tagging system.
Figure 5:
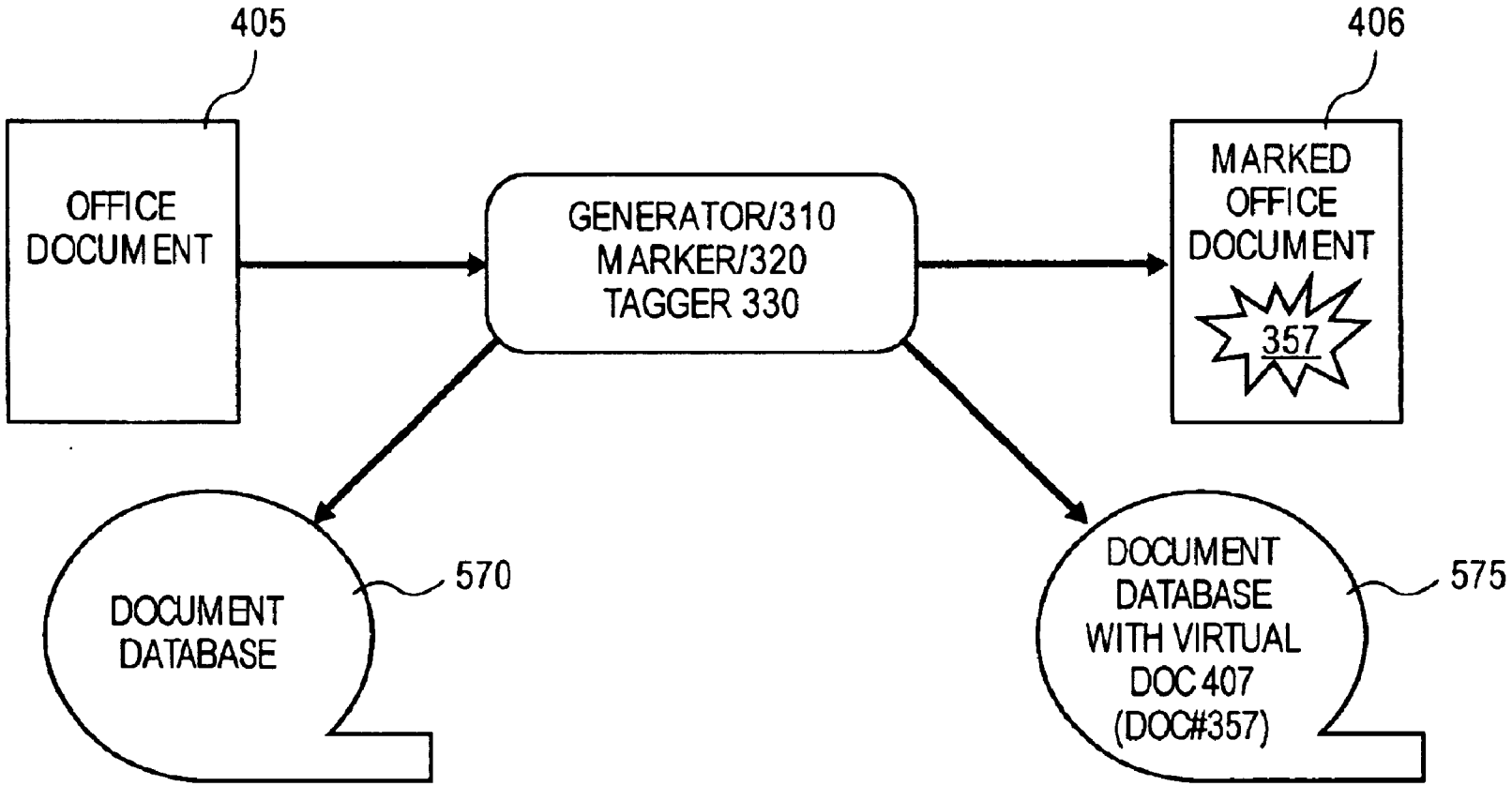
FIG. 5 is a block diagram of yet another embodiment of the generating/tagging system.

FIG. 3 is a block diagram of one embodiment of the generating/tagging system. In FIGS. 3, 4 and 5, like numbered blocks signify components having a similar function. Generator 310, generates from a physical materiality a virtual article that is intelligible to digital processing system. Generator 310 is coupled to marker 320 and tagger 330. Marker 320 assigns an identifier to the physical materiality. Tagger 330 tags the virtual article with a tag that corresponds to the identifier. The virtual article with the tag and the physical materiality with the identifier may be recognized and associated with each other, as well as with other virtual articles and/or physical materialities.

In another embodiment, marker 320 may be omitted. In such case, tagger 330 tags the virtual article with an identifying tag.

FIG. 4 is a block diagram of another embodiment of the generating/tagging system. Physical materiality 405 is inserted into generator 310. Generator 310 generates virtual article 407. Virtual article 407 is communicated to tagger 330 and digital processing system 460. Generator 310 is coupled to log maintainer 450. Log maintainer 450 maintains a log of the generating of the virtual article 407. Recognizer 440 is coupled to tagger 330, and digital processing system 460. Recognizer 440 recognizes virtual article 408 which has a tag placed on it by tagger 330 by its tag. After passing through generator 310, physical materiality is marked by marker 320. User 480 can recognize physical materiality 406 because it has a mark placed on it by marker 320. The mark on the physical materiality 406 corresponds to the tag placed on tagged virtual article 408.

FIG. 5 is a block diagram of another embodiment of the generating/tagging system. Physical document 405 is one example of a physical materiality 405, as described above with reference to FIG. 4. Physical Document 405 is fed to generator 310/marker 320/tagger 330. In one embodiment, generator 310, market 320, and tagger 330 are components of a single device. In another embodiment, generator 310, marker 320 and tagger 330 are coupled together. Document database 570 is coupled to converter 310/marker 320/tagger 330. Physical document 405 is marked with a mark by marker 320 resulting in the production of physical document 406 having the mark. In the embodiment shown by FIG. 5, physical document 405 is marked with number "357" to produce marked physical document 406, having the mark "357". Physical document 405 is also used to generate a virtual document 407 having a tag of "357". The tag on virtual document 408 corresponds with the mark on marked physical document 406. Document database 575 stores tagged virtual document 408.

In another embodiment, the mark placed on physical document 405 is given a particular orientation which may later be used to align physical and virtual documents. For example, the mark may have a shape, such as, for example an obelisk shape, that when placed on physical document 405 serves to orient physical document 405 in only one direction. When the virtual document 407 is generated from the physical document 405, the orientation of the mark passes with the physical document 405 into virtual form, as meta-information or otherwise. Thus, the tag on virtual document 407 will have a particular orientation.

In one embodiment, the mark with the particular orientation on physical document 405 may be used to orient the physical document 405 when it is being fed into generator 310 at a later point in time so that each virtual document generated from physical document 405 may be oriented in the same direction. In another embodiment, the tag with the particular orientation on virtual document 407, which corresponds to the mark on physical document 405 with the particular orientation, may be used to align a first generation of a virtual document 407 generated from physical document 405 and a later generation of a virtual document 407 generated from the same physical document 405.

For example, a physical document 405 may be used to generate a virtual document 407 on Monday. The physical document 405 is given a mark with a particular orientation and the virtual document 407 is given a corresponding tag having a particular orientation. Two days later, after changes have been made to physical document 405, a new virtual document 407 must be generated using the revised physical document 405. The mark with the particular orientation on revised physical document 405 may be used to orient the document as it is fed into generator 310 so that the document is in the same orientation as it was when the un-revised physical document 405 was fed into generator 310 two days prior. Conversely, the tag with the particular orientation on the new virtual document 407 can be used to align the first generation virtual document 407 and the new virtual document 407, such as, for example, if the revised physical document 405 was improperly fed into generator 310 and the virtual document 407 needed to be properly oriented. It will be appreciated that a mark with a particular orientation and a tag with a particular orientation may be used not only in conjunction with physical documents but also with other types of physical materialities as well.

FIG. 6 shows one example of a typical computer system which may be used with the present invention. Note that while FIG. 6 illustrates various components of a computer system, it is not intended to represent any particular architecture or manner of interconnecting the components as such details are not germane to the present invention. It will also be appreciated that network computers and other data processing systems which have fewer components or perhaps more components may also be used with the present invention.

As shown in FIG. 6, the computer system 601, which is a form of a data processing system, includes a bus 602 which is coupled to a microprocessor 603 and a ROM 607 and volatile RAM 605 and a non-volatile memory 606. The microprocessor 603 is coupled to cache memory 604 as shown in the example of FIG. 6. The bus 602 interconnects these various components together and also interconnects these components 603, 604, 605, and 606 to a display controller and display device 608 and to peripheral devices such as input/output (I/O) devices which may be mice, keyboards, modems, network interfaces, printers and other devices which are well known in the art. The I/O devices may also include a virtual document generator/marker/tagger device 300. Typically, the input/output devices 610 are coupled to the system through input/output controllers 609. The volatile RAM 605 is typically implemented as dynamic RAM (DRAM) which requires power continually in order to refresh or maintain the data in the memory. The non-volatile memory 606 is typically a magnetic hard drive or a magnetic optical drive or an optical drive or a DVD RAM or other types of memory systems which maintain data even after power is removed from the system. Typically, the non-volatile memory will also be a random access memory although this is not required. While FIG. 6 shows that the non-volatile memory 606 is a local device coupled directly to the rest of the components in the data processing system, it will be appreciated that the present invention may utilize a non-volatile memory which is remote from the system, such as a network storage device which is coupled to the data processing system through a network interface such as a modem or Ethernet interface. The bus 602 may include one or more buses connected to each other through various bridges, controllers and/or adapters as is well known in the art. In one embodiment the I/O controller 609 includes a USB (Universal Serial Bus) adapter for controlling USB peripherals.

It will be apparent from this description that aspects of the present invention may be embodied, at least in part, in machine-executable instructions, e.g. software. That is, the techniques may be carried out in a computer system or other data processing system in response to its processor, such as a microprocessor, executing sequences of instructions contained in a memory, such as ROM 607, volatile RAM 605, non-volatile memory 606, cache 604 or a remote storage device. In various embodiments, hardwired circuitry may be used in combination with software instructions to implement the present invention. Thus, the techniques are not limited to any specific combination of hardware circuitry and software nor to any particular source for the instructions executed by the data processing system. In addition, throughout this description, various functions and operations are described as being performed by or caused by software code to simplify description. However, those skilled in the art will recognize what is meant by such expressions is that the functions result from execution of the code by a processor, such as the microprocessor 603.

Figure 7:
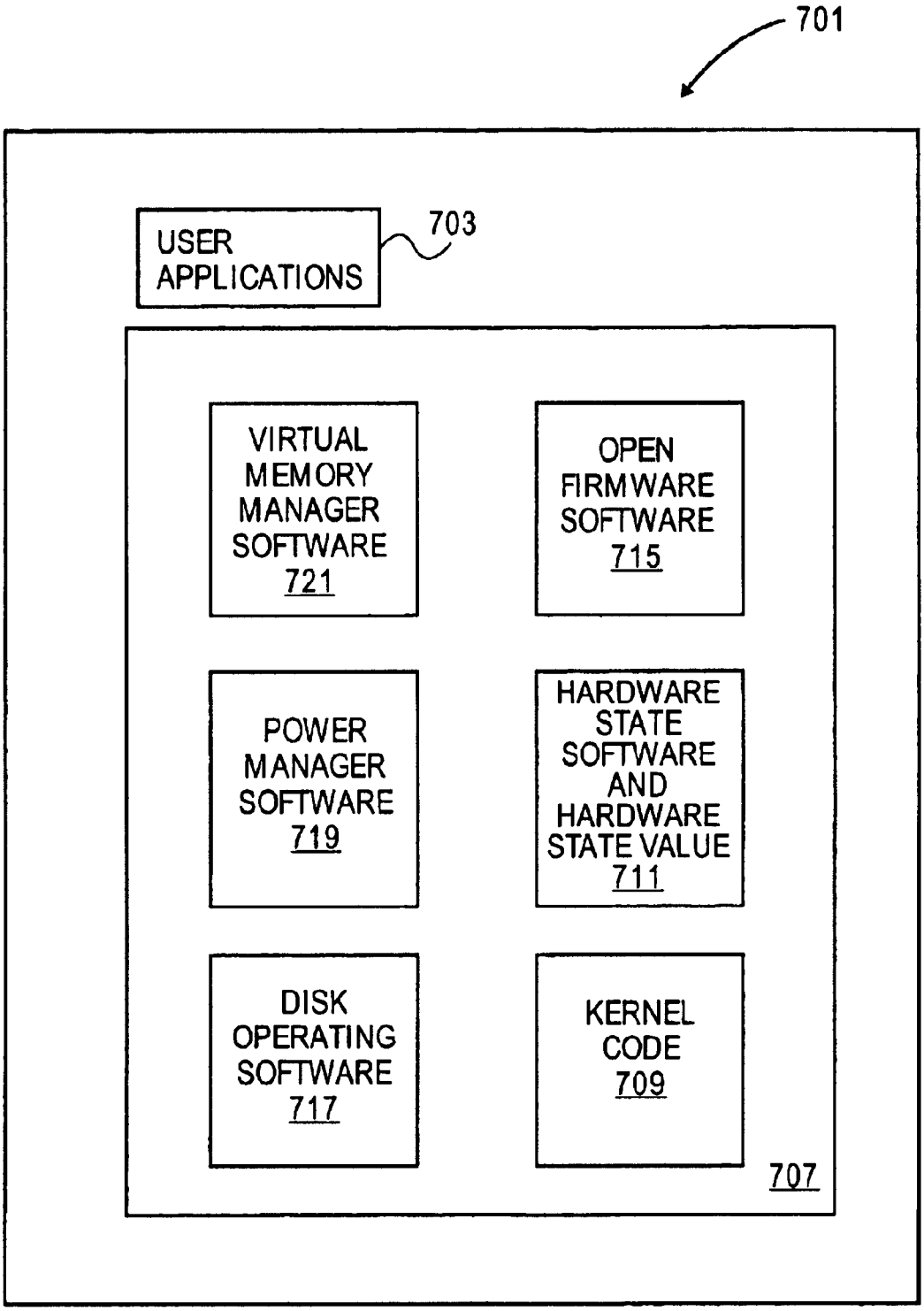
FIG. 7 is a diagram of a computer readable media, which may be used within an operating environment, such as the operating environment of FIG. 6, according to one embodiment of the present invention.

FIG. 7 shows an example of a computer readable media, which may be used with the data processing system according to one embodiment of the present invention. The computer readable media contains data and executable software which when executed in the data processing system such as a digital processing system cause the system to perform the various methods of the present invention. As noted above, this executable software and data may be stored in various places including for example the ROM 607, the volatile RAM 605, the non-volatile memory 606 and/or the cache 604. Portions of this software and/or data may be stored in any one of these storage devices. The media 701 for example may be primarily the volatile RAM 605 and the non-volatile memory 606 in one embodiment. The user applications 703 represent software applications, which are executing on the computer system, such as a word processing application or a spreadsheet application, an Internet web browser application, or a virtual document generation and tagging application. The operating system 707 includes the Open Firmware software 715 which may be stored in the ROM 607 and loaded into RAM 605 at boot up. The hardware state software and hardware state value 711 is the software which generates the hardware state value. The kernel code 709 represents the kernel of the operating system and performs numerous tasks. The virtual memory manager software 721 controls the virtual memory process. This typically involves maintaining a map of page data which represents the state of data in all the virtual memory which includes the physical RAM such as volatile RAM 605 and a portion of the non-volatile memory 606 which has been designated as part of the virtual memory of the system. The virtual memory manager software will be performing conventional virtual memory processes as is known in the art. The power manager software 719 performs the various power managing operations such as notifying applications and the system and drivers of changes to the power consumption state of the system. The software may also monitor the state of a computer battery to determine whether sufficient power exists to continue to operate and displays alerts to the user indicating the status of the battery and the power status of the system. The disk operating system software 717 performs the conventional functions of a disk operating system. This typically includes controlling the operation of a hard disk drive which in many examples is the non-volatile memory 606 which serves as a virtual memory for the volatile RAM 605.

Figure 8:
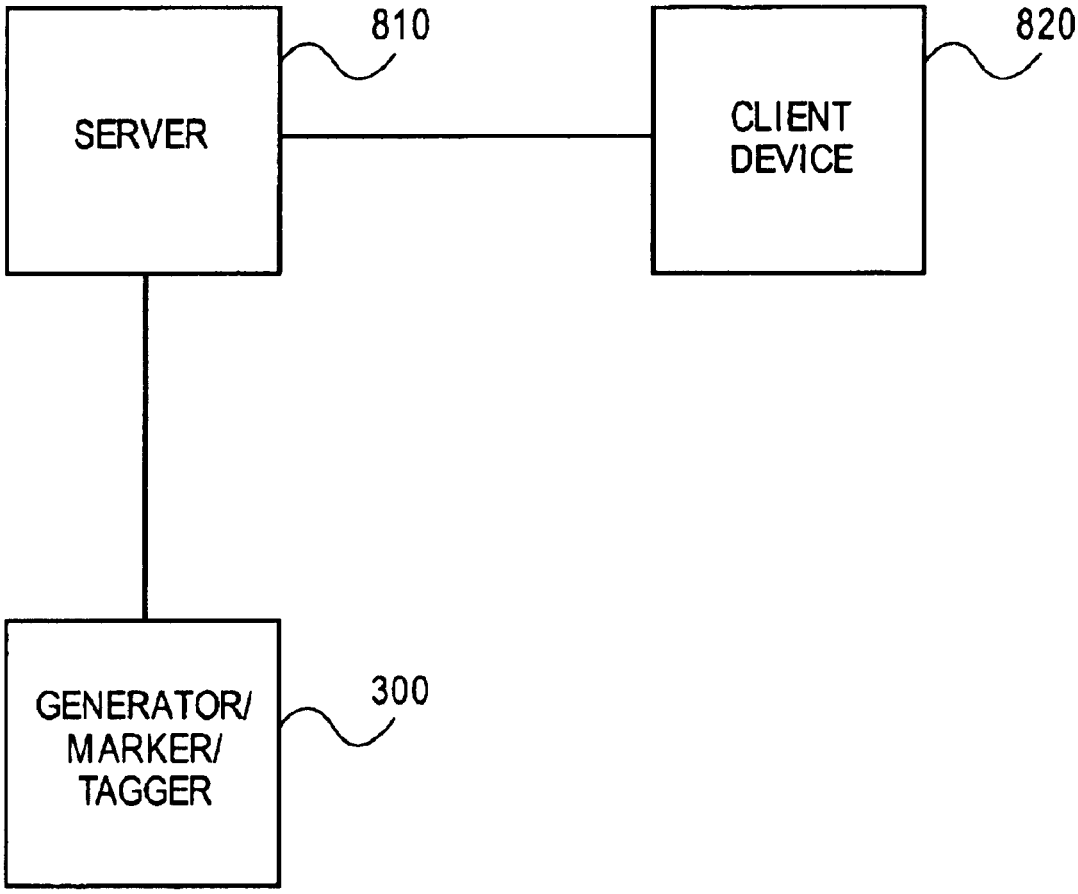
FIG. 8 is diagram of one embodiment of a system-level overview of the present invention.

FIG. 8 is diagram of one embodiment of a system-level overview of the present invention. Generator/marker/tagger 300 ("document processor") is communicatively coupled to server 810. Server 810 receives a tagged virtual document from generator/marker/tagger 300 after it has been processed by generator/marker/tagger 300. Server 810 is communicatively coupled to client device 820. Client device 820 can access virtual documents processed by generator/marker/tagger 300 via server 810. In one embodiment, client device 820 is a digital processing system. In another embodiment, client device 820 creates a database using the virtual documents received from generator/marker/tagger 300 via server 810.

It will be further appreciated that the instructions represented by the blocks in FIGS. 1 and 2 are not required to be performed in the order illustrated, and that all the processing represented by the blocks may not be necessary to practice the invention.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A method comprising:

generating a digital simulation of a physical materiality;

marking the physical materiality with an identifier; and tagging the digital simulation of the physical materiality with a tag that corresponds to the identifier, the generating, marking and tagging occurring at substantially the same time.

2. The method as set forth in claim 1, further comprising, enabling the physical materiality to be recognized by a user by the identifier.

3. The method as set forth in claim 1, wherein the generating further comprises performing a physical analysis.

4. The method as set forth in claim 3, wherein the physical analysis is selected from the group consisting of:

a spectral analysis;

a chromatographic analysis; and a DNA analysis.

5. The method as set forth in claim 1, further comprising recognizing the digital simulation of the physical materiality, with the digital processing system, by the tag.

6. The method as set forth in claim 1, further comprising maintaining a log of the generating of the digital simulation of the physical materiality.

7. The method as set forth in claim 6, wherein items kept in the log are selected from the group further comprising;

the tag;

the digital simulation of the physical materiality; and a copy of the digital simulation of the physical materiality.

8. The method of claim 1, wherein the generating includes performing a physical analysis, by a machine, of a feature or state of the physical materiality to create the digital simulation.

9. An apparatus comprising:

a generator to generate a digital simulation of a physical materiality;

a marker communicatively coupled to the generator to mark the physical materiality with an identifier; and a tagger communicatively coupled to the generator to tag the digital simulation of the physical materiality with a tag that corresponds to the identifier.

10. The apparatus as set forth in claim 9, wherein the physical materiality has no pre-coding of identifying information.

11. The apparatus as set forth in claim 9, wherein the identifier is selected from the group consisting of:

a label;

a code printed onto the physical materiality;

a digital overlay; and a radio frequency identification (RFID) tag.

12. The apparatus as set forth in claim 9, wherein the physical materiality is selected from the group consisting of:

a document having text;

an illustration;

a hand written note;

a biological sample; a a chemical sample.

13. The apparatus as set forth in claim 9, wherein the identifier has a particular orientation to orient the physical materiality for processing.

14. The apparatus as set forth in claim 9, wherein the tag has a particular orientation to orient the digital simulation of the physical materiality for processing.

15. The apparatus as set forth in claim 9, wherein the generator is selected from the group consisting of:

a physical analyzer; and a document scanner.

16. The apparatus of claim 9, wherein the generator is a device to perform a physical analysis of a feature or state of the physical materiality and to create the digital simulation.

17. A system comprising:

a processing unit; and a memory coupled to the processing unit through a bus, the processing unit to execute a document generation and tagging process from the memory to generate a digital document that is simulated from a physical document, to mark the physical document with an identifier, and to tag the digital document with a tag that corresponds to the identifier.

18. The system as set forth in claim 17, wherein the digital document is recognized by a digital processing system by reference to the tag.

19. The system as set forth in claim 17, wherein a log is maintained of the digital document by the processing unit in the memory, the log indexing the digital document based upon its tag.

20. The system of claim 17, wherein the system is to perform a physical analysis of the physical document to create a digital simulation of a feature or state of the physical document.

21. An article comprising a machine-readable medium having stored thereon a plurality of instructions, which if executed by a machine, cause the machine to perform:

generating a digital simulation of a physical materiality;

marking the physical materiality with an identifier; and tagging the digital simulation of the physical materiality with a tag that corresponds to the identifier, the generating, marking and tagging occurring at substantially the same time.

22. The article as set forth in claim 21, wherein the plurality of instructions to be executed by the machine further comprise recognizing, after the tagging, the digital simulation of the physical materiality, with a digital processing system, by the tag.

23. The article as set forth in claim 21, wherein the plurality of instructions to be executed by the machine further comprise maintaining a log of the generating of the digital simulation of the physical materiality.

24. The article of claim 21, wherein the generating includes performing a physical analysis, by a machine, of a feature or state of the physical materiality to create the digital simulation of the physical materiality.

25. A system comprising:

a document processor comprising:

a generator to generate a digital document that is simulated from a physical materiality;

a marker communicatively coupled to the generator to assign an identifier to the physical materiality; and a tagger communicatively coupled to the generator to tag the digital document with a tag that corresponds to the identifier;

a server coupled to the document processor to receive the digital document from the document processor after processing by the document processor and to transmit the digital document received to a client device.

26. The system as set forth in claim 25, wherein the client device is a digital processing system.

27. The system as set forth in claim 25, wherein the client device creates a database using the digital document received from the server.

28. The system of claim 25, wherein the generator is a device to perform a physical analysis of the physical materiality so that the digital document is a digital simulation of a feature or state of the physical materiality.

* * * * *